US007089622B2

(12) United States Patent
Sampaio

(10) Patent No.: US 7,089,622 B2
(45) Date of Patent: Aug. 15, 2006

(54) WRING MOP

(76) Inventor: Andre Sampaio, 400 Corporate Dr., Blauvelt, NY (US) 10913

( * ) Notice: Subject to any disclaimer, the term of this patent is extended or adjusted under 35 U.S.C. 154(b) by 0 days.

(21) Appl. No.: 10/911,830

(22) Filed: Aug. 5, 2004

(65) Prior Publication Data

US 2006/0026785 A1 Feb. 9, 2006

(51) Int. Cl.
*A47L 13/142* (2006.01)

(52) U.S. Cl. ..... 15/120.2; 15/120.1

(58) Field of Classification Search ..... 15/120.1, 15/120.2

See application file for complete search history.

(56) References Cited

U.S. PATENT DOCUMENTS 1,709,622 A 4/1929 Justis
2,677,838 A * 5/1954 Jouban ..... 15/120.2
5,060,338 A 10/1991 Yates et al.
5,566,417 A * 10/1996 Hsieh ..... 15/120.2
6,085,378 A 7/2000 Petner
6,108,848 A * 8/2000 Monahan ..... 15/119.1
6,625,838 B1 9/2003 Laux et al.
2002/0133892 A1* 9/2002 Monahan ..... 15/119.1
2003/0000036 A1* 1/2003 Fan ..... 15/120.1

* cited by examiner

*Primary Examiner*—Randall Chin
(74) *Attorney, Agent, or Firm*—Stephen E. Feldman

(57) ABSTRACT

The present invention provides a wring mop with a lever handle. The handle adds leverage and torque to the wringing operation of the mop head. A more thorough wringing is achieved with more liquid removed from the mop.

5 Claims, 3 Drawing Sheets

WRING MOP

FIELD OF THE INVENTION

The present invention deals with mops and more specifically, a mop with a wringing sleeve having an integrated handle.

BACKGROUND OF THE INVENTION

There exist numerous types of mops in the art used to clean surfaces such as floors, including twist mops, squeeze mops, ringer mops, etc. Each of these mops include a handle for supporting a mop head at one end thereof and additionally typically include means for removing liquid from the mop head.

In one such construction, a wringing tube or sleeve is mounted to the handle and is adapted to be slid over a mop head to wring or compress water therefrom. Further, the sleeve in one known prior art type device is configured to ensure a certain degree of resistance between the sleeve and the mop head to facilitate twisting, and preferably complete wringing, of the mop head. For example, U.S. Pat. No. 1,709,622 (Justis) purports to show providing inwardly extending ribs on a sleeve located between opposing longitudinal ends of the sleeve to facilitate engagement of the strands of a mop head. A further example of such a mop is shown in U.S. Pat. No. 5,060,338 (Yates et al.) that purports to disclose a sleeve formed with a plurality of inwardly extending grooves extending along a substantial portion of the axial length of the sleeve and located between the opposing ends of the sleeve.

In other constructions of sleeves for squeezing a mop head, the sleeve is configured to provide a compression of the mop head to thereby compress water from the mop strands. For example, U.S. Pat. No. 6,108,848 (Monahan) purports to show a housing for compressing the mop head wherein the housing is provided with a slit to permit the housing to movably overlap itself and change a mop head receiving surface area to compress water from the mop head. A further known construction is disclosed in U.S. Pat. No. 6,085,378 (Petner) that purports to show a sleeve including a plurality of rollers for engaging and wringing a mop head as the sleeve is moved longitudinally down over the mop head.

Lastly, U.S. Pat. No. 6,625,838 (Laux, et al.) purports to disclose a mop with a handle and a mop head located at one end of the handle with a plurality of flexible strands defining a mop body. A sleeve is positioned on the mop handle and is supported for slidable movement in an axial direction parallel to the handle, and is further supported for rotatable movement relative to the handle.

There is a continuing need to provide an improved means for wringing a mop head, and in particular, there is a continuing need for providing a self-contained wringer which is capable of efficiently manipulating a mop head to dispense liquid therefrom during a wringing operation of the mop head. None of the references mentioned above include a handle providing added leverage and increased torque to the mop head, thereby removing more liquid than previously possible.

SUMMARY OF THE INVENTION

The present invention provides a wring mop with a lever handle. The handle adds leverage and torque to the wringing operation of the mop head. A more thorough wringing is achieved with more liquid removed from the mop.

In further detail, the mop comprises a handle with a first end and a second end. There is a mop body on the second end, the mop body having mop strands extending therefrom. A sleeve is on the second end, with a lever handle extending at a substantially right angle from the sleeve. Engagement means in the sleeve are constructed and arranged to engage the mop strands. The sleeve is constructed and arranged to slide and rotate around the handle and facilitate a wringing action on the strands.

DETAILED DESCRIPTION

Figure 1:
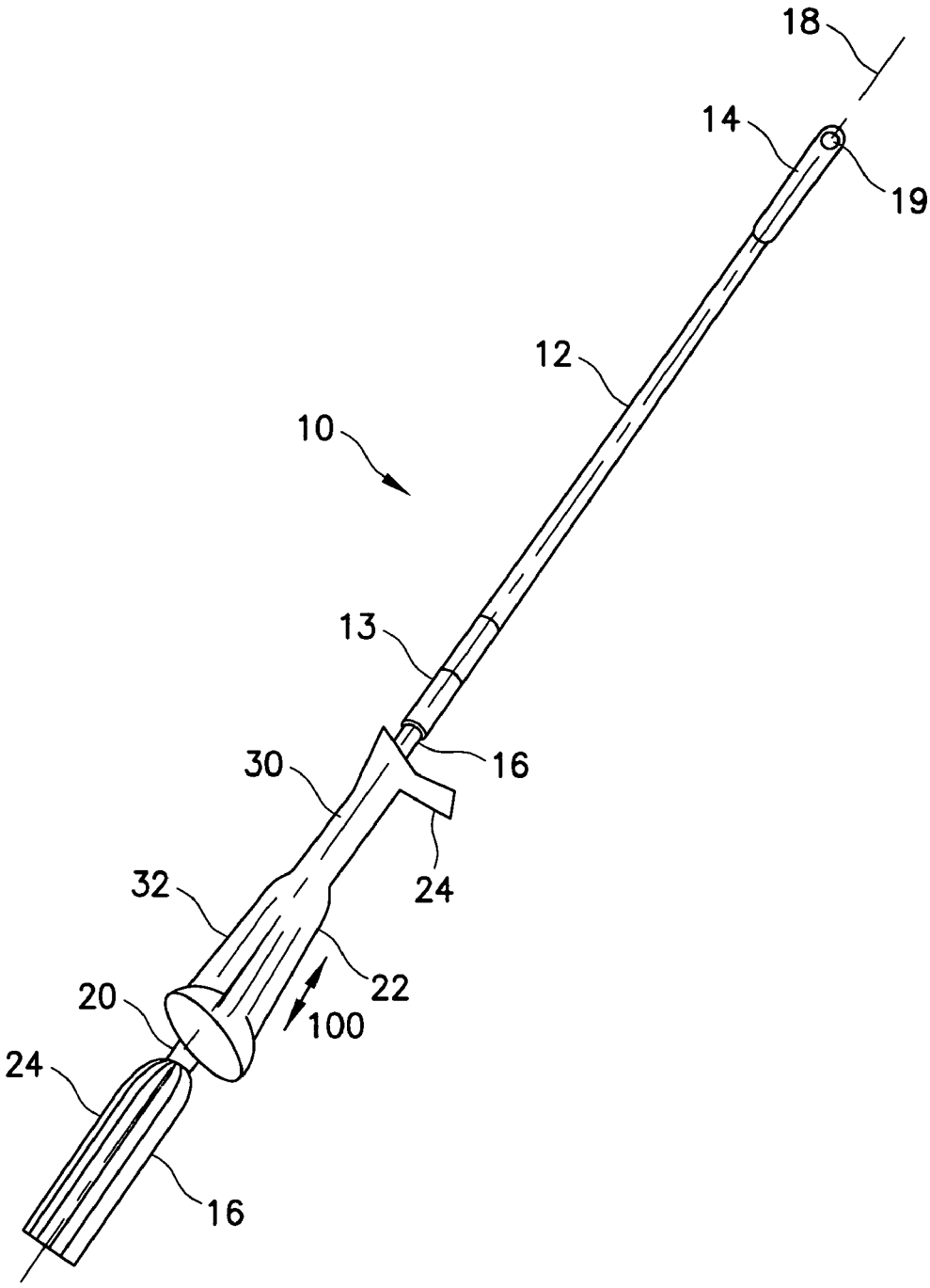
FIG. 1 depicts a mop according to a preferred embodiment of the present invention.
Figure 2:
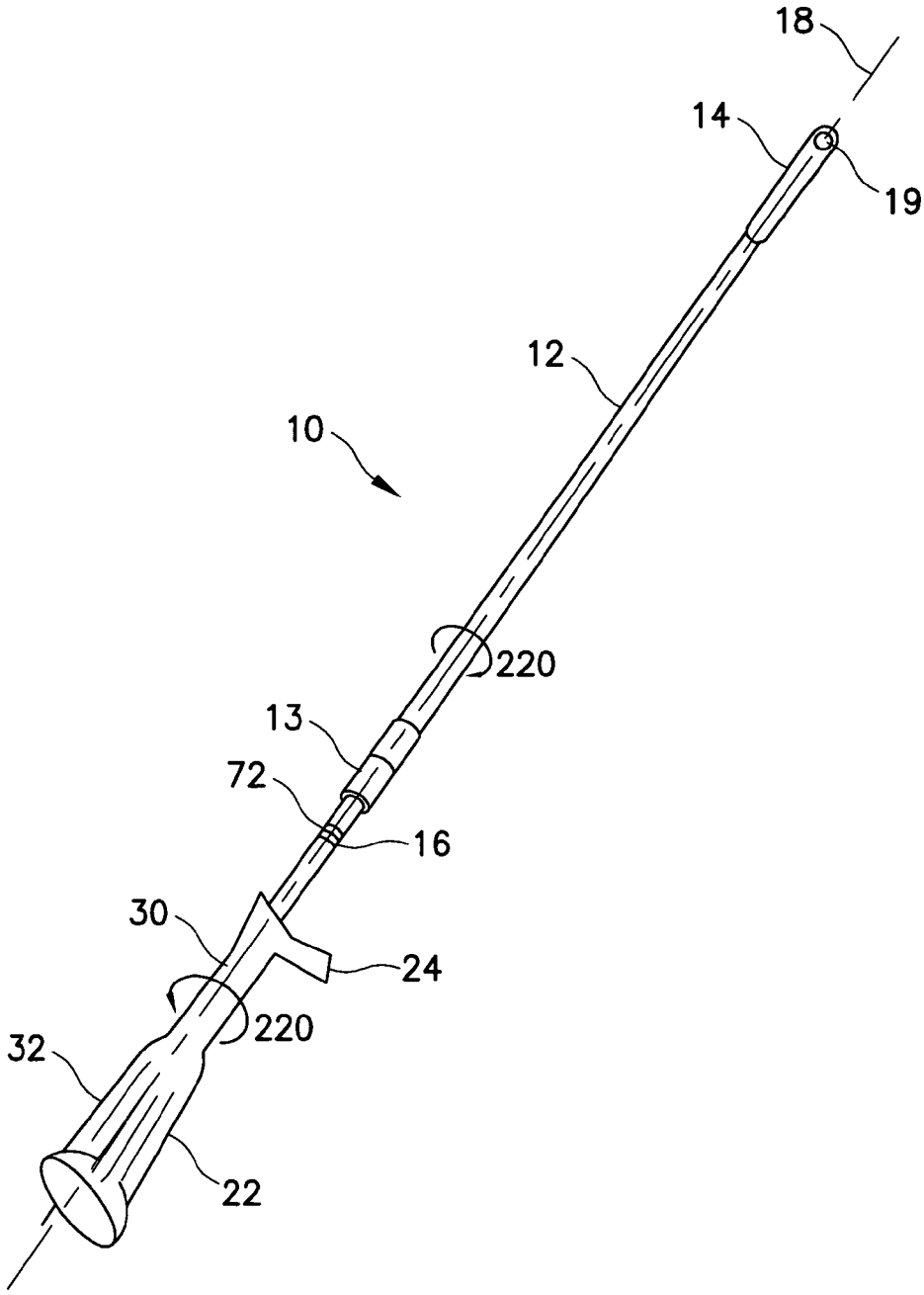
FIG. 2 shows the mop of FIG. 1 with the sleeve extended over the mop head.

Referring to FIGS. 1 and 2, the mop 10 of the present invention includes a mop handle 12 having a first end 14 and a second end 16 defining a longitudinal axis 18. The first end 14 has a bore 19 through its full width for hanging the mop 10 during storage.

The mop head 20 includes a plurality of flexible strands 26 defining a mop body 25. The mop head 20 may be formed of any strand material known in the art, including strips of absorbent and durable material, such as woven or non-woven natural or synthetic materials, or may consist of a yarn material or any other material capable of providing a strand-like mop body.

The mop 10 further includes a substantially cylindrical sleeve 22 located adjacent the second end 16 and further comprising a lever handle 24. The sleeve 22 and handle 24 are preferably formed of a resilient material, such as a soft vinyl material formed to provide a textured, non-slip surface. The location of the lever handle 24 is provided such that it may be used to facilitate a wringing operation, as will be described further below.

The mop 10 is additionally provided with a wringer element comprising a sleeve 22 including a first, upper grip portion 30 and a second, lower mop body receiving portion 32. As may be seen with reference to FIGS. 1–3, the sleeve 22 is defined by an inner surface 34 and an outer surface 36 extending circumferentially around the longitudinal axis 18 to form a tubular shell surrounding and slidable along the mop handle 12 in the directions indicated by arrow 100. In particular, it should be noted that the inner surface 34 along the grip portion 30 is formed with a diameter greater than the diameter of the mop handle 12 whereby the sleeve 22 is both rotatable and longitudinally movable relative to the handle 12.

The mop body receiving portion 32 of the sleeve 22 is formed with a larger diameter than the grip portion 30 and defines an engagement portion for engaging the mop body 25 and for facilitating gripping and twisting of the mop strands 26 during rotational movement of the sleeve 22 relative to the handle 12 indicated by arrow 200.

In use, the sleeve 22 is moved downwardly to engage the inner surface 34 over the mop body 25. As the sleeve 22 is moved downwardly, a plurality of the strands forming the mop body 25 will engage engagement means on the interior of the sleeve 22. The engagement means are oriented such that the strands of the mop body 25 are rotated in a circular direction, as viewed from the bottom of the mop 10. Thus, as the sleeve 22 is rotated, it facilitates engagement with and twisting of the mop strands 26 to produce a rotational wringing movement of the strands of the mop body 25 relative to the handle 12.

The engagement means for securing the mop strands and facilitating a wringing operation are well known in the art. Examples are provided in U.S. Pat. No. 6,625,838 to Laux et al. and the references cited therein.

Further, it should be noted that the hand grip 13 on the handle 12 and the lever 24 on the sleeve 22 provide convenient locations for a person to grip and rotate the sleeve 22 relative to the handle 12. The handgrip 13 adds extra leverage and thus, more torque, achieving a more thorough wringing of the mop strands.

In performing a wringing operation, the sleeve 22 is moved longitudinally downwardly toward the mop head 20 to the position shown in FIG. 2 whereby the sleeve engages the strands. The hand grip 13 provides a location on the handle 12 for an operator to hold the mop handle 12, and the operator further grips the lever handle 24 of the grip portion 30 of the sleeve 22 to rotate the sleeve 22 relative to the mop body 25 as indicated by arrows 200 and 220. During the rotation of the sleeve 22, the mop strands remain fixed to facilitate a wringing operation.

The handle 12 has a number of ribs 72 formed on its outer surface for engaging the interior of the grip portion 30 of the sleeve 22 which has a matching inverse rib pattern (not shown) defining a diameter slightly less than the diameter of the handle ribs 72. In a storage position of the sleeve 22, the sleeve may be moved upwardly to the position shown in FIG. 1 to engage the ribs of the grip portion 30 over the handle ribs 72 whereby the frictional engagement between the inner surface of the grip portion 30 of the sleeve 22 and the handle ribs 72 maintains the sleeve 22 in an elevated position out of engagement with the mop body 25.

Figure 3:
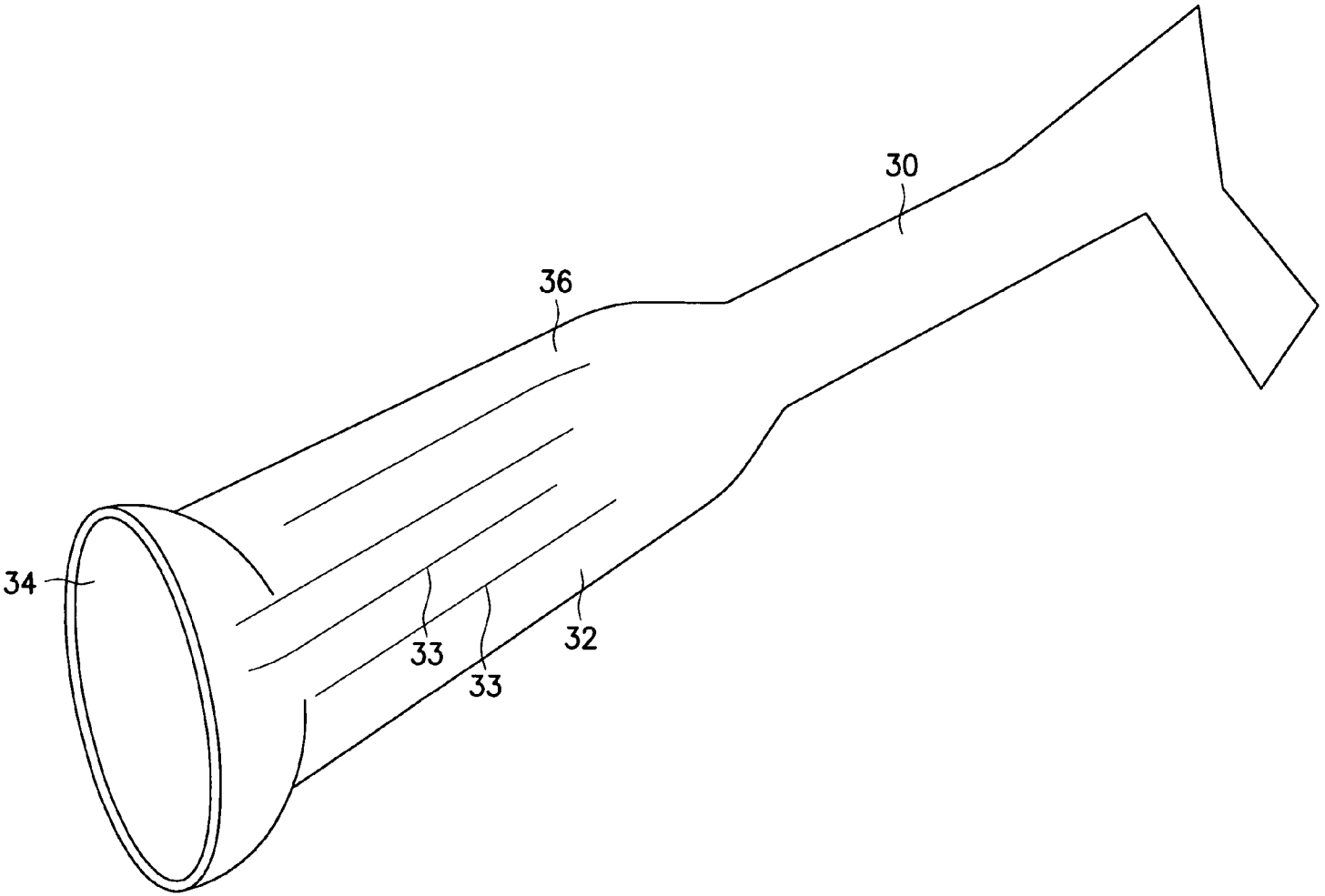
FIG. 3 shows a sleeve according to an embodiment of the present invention.

Referring to FIG. 3, a first alternative embodiment of the wringer sleeve 22 is illustrated in which the mop body receiving portion 32 is formed with a circular shape and ribs 33 are provided on the outer surface of the mop body receiving portion 32.

Alternative embodiments of the wringer sleeve 22 include different shapes such as triangles and squares. The sleeve 22 would function in the same manner, but the outside shape, when viewed from the top or bottom would resemble a triangle or square rather than a circle. So instead of resembling a cylinder, the sleeve would resemble a tubular triangle or rectangular box. Other variations on the shape may be effected without escaping the scope of the invention.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A mop comprising:

a handle having a first end, a second end and an outer surface, the handle being defined by a longitudinal axis;

a hand grip, said hand grip being in-line with said longitudinal axis of the handle;

a mop body on the second end, the mop body having mop strands extending therefrom;

a sleeve on the second end, the sleeve having an inner surface and a lever handle extending at a substantially right angle from the sleeve;

a plurality of ribs, said ribs formed on the outer surface of the handle and the inner surface of the sleeve, whereby said ribs allow the sleeve to be held in an elevated position;

engagement means in the sleeve constructed and arranged to engage the mop strands;

wherein the sleeve is constructed and arranged to slide and rotate around the handle to facilitate a wringing action on the strands in conjunction with the engagement means.

2. The mop of claim 1 wherein the handle further comprises a bore.

3. The mop of claim 1 wherein the mop strands are natural fibers.

4. The mop of claim 1 wherein the mop strands are synthetic fibers.

5. The mop of claim 1 wherein the mop strands are a yarn material.

* * * * *

UNITED STATES PATENT AND TRADEMARK OFFICE

CERTIFICATE OF CORRECTION

PATENT NO. : 7,089,622 B2
APPLICATION NO. : 10/911830
DATED : August 15, 2006
INVENTOR(S) : Andre Sampaio It is certified that error appears in the above-identified patent and that said Letters Patent is hereby corrected as shown below:

Title Page Should read

The Assignee is: Kaminstein Imports, Inc.
400 Corporate Drive
Blauvelt, New York 10913

Signed and Sealed this

Thirtieth Day of December, 2008

JON W. DUDAS
*Director of the United States Patent and Trademark Office*